US005199122A

United States Patent [19]

Styblo

[11] Patent Number: 5,199,122

[45] Date of Patent: Apr. 6, 1993

[54] BED ANGLE-ELEVATORS

[76] Inventor: Norbert Styblo, 33 Tremont St., Carver, Mass. 02330

[21] Appl. No.: 865,223

[22] Filed: Apr. 8, 1992

[51] Int. Cl.[5] ..... A47C 21/00; A47C 31/00

[52] U.S. Cl. ..... 5/509.1; 248/188.2

[58] Field of Search ..... 5/509.1, 11, 658, 310; 248/188.2

[56] References Cited

U.S. PATENT DOCUMENTS

Re. 18,647 11/1932 Phillips ..... 248/188.2
2,933,850 4/1960 Martin ..... 5/509.1
2,935,813 5/1960 Berman et al. ..... 248/188.2
4,117,999 10/1978 Gessler ..... 248/188.2
4,312,088 1/1982 Webb ..... 5/11

*Primary Examiner*—Alexander Grosz

[57] ABSTRACT

An extension or elevator device for the legs supporting bed-frames of various design, which are arranged to raise the head of the bed. The resultant pitching of the sleeping surface is to reduce stomach acid reflux into the esophagus in the condition Reflux Esophagitis (commonly: heartburn) during bedrest. Device is installed in place of casters or gliders, and has provision for replacing casters in order to retain the original floor-bearing and mobility characteristics of the bed.

1 Claim, 2 Drawing Sheets

BED ANGLE-ELEVATORS

BACKGROUND OF THE INVENTION

1. Field of the Invention

The present invention relates to beds, specifically to devices which may be applied to the legs of bedframes for the purpose of extension, in a configuration resulting in the angling of the sleeping-surface.

2. Description of Related Art

Reflux Esophagitis (commonly: heartburn) is a painful medical condition typically caused by the reflux of stomach acid into the esophagus. Discomfort can be acute and persistent, particularly to people suffering from a hiatus hernia. Due to the relative position of stomach and esophagus, lying flat in bed usually increases the likelihood of acid reflux, and the discomfort it causes.

A common solution recommended by the medical profession for pain relief during bedrest is to elevate the head of the patient's bed four or five inches (10 or 12.7 cm.), thereby angling the sleeping surface to physically prevent acid reflux. Usually this is followed by a suggestion for the patient to improvise some sort of blocking under the bed legs of appropriate height to accomplish this end. While a simple and effective solution, this method can be unstable, can cause damage to floor finishes, and negates the usefulness of casters or gliders for facilitating bed mobility.

BRIEF SUMMARY OF THE INVENTION

The preferred embodiment of the present invention comprises on one end a rigid pin, or a rigid pin surrounded by a conical sleeve. The opposite end has a cylindrical receptacle of similar diameter to the pin, mentioned above. The body of the device between the axial compression bearing surfaces, at the base of the pin and at the opening of the receptacle, measures four to five inches (10 to 12.7 cm.) in length.

The device is assembled to the leg of the bed by first removing the castor or glider. Then, the pin on the invention is inserted into the caster hole, and the caster is fitted to the receptacle in the other end, completing assembly. For beds equipped with legs supporting the mid-span of the frame, a special version of the device half as long would be assembled in similar fashion.

The objective is to install an array of the elevator devices which raises the head of the bed a net four or five inches (10–12.7 cm.), thereby pitching the sleeping surface toward the foot of the bed. In so doing, stomach acid reflux into the esophagus is less likely, while the floor-bearing and mobility characteristics of the bed are unaffected.

Figure 1:
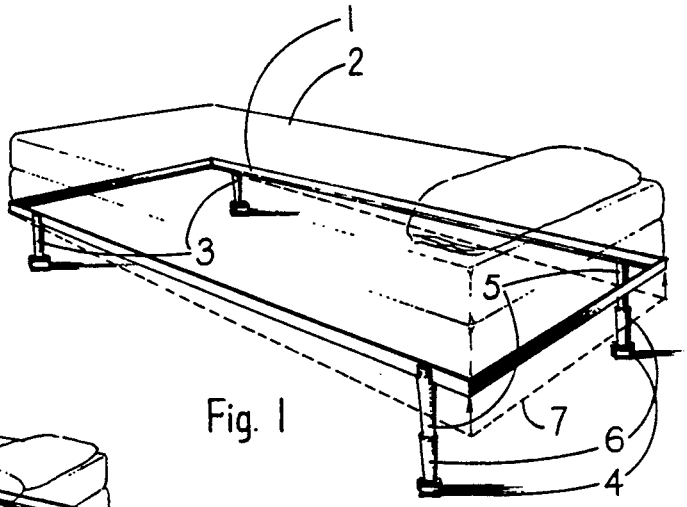
FIG. 1: A perspective view showing a representative four-legged bed with elevator devices installed, and the vertical displacement of the sleeping surface.

In describing the preferred embodiment of this invention, as depicted in the drawings, it is understood that selected terminology herein is for the purpose of clarity, and it is not intended that the invention be limited to these specific terms. Each term includes all technical equivalents which function similarly to accomplish the same purpose.

DETAILED DESCRIPTION OF THE INVENTION:

Refer to FIG. 1; A representative metal bed-frame equipped with four legs, 1, is shown supporting typical bedding, 2. The two legs supporting the foot of the bed, 3, are unaltered. At the head of the bed, the casters or gliders are removed from the legs, 5, the elevator devices, 6, are installed in their place, and the casters/gliders, 4, are fitted. This results in the angling of the sleeping surface from the original flat orientation, 7, and the retention of the floor-bearing and mobility characteristics of the bed.

Figure 1A:
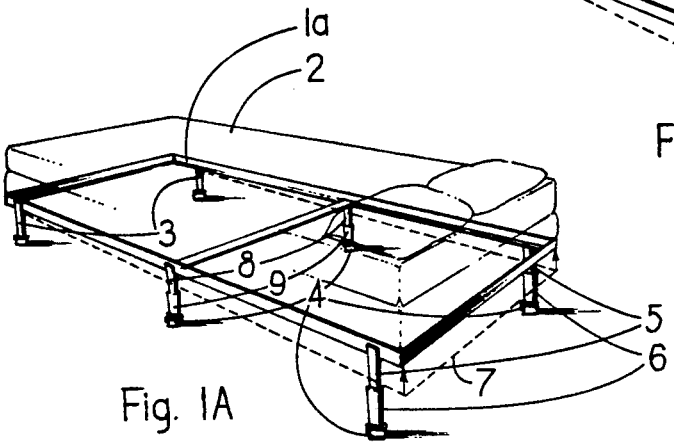
FIG. 1A: A perspective view showing a representative six-legged bed, with standard and half-length elevators installed, and the vertical displacement of the sleeping surface.

Refer to FIG. 1A; A representative metal bed-frame equipped with six legs, as is often the case with larger sizes, 1*a*, is shown supporting typical bedding, 2. Full-length elevator devices, 6, are added to the legs supporting the head of the bed, 5. To the legs at mid-span, 8, half-length elevators, 9, are fitted. This results in the angling of the sleeping surface from its original flat orientation, 7, and the retention of the floor-bearing and mobility characteristics of the bed.

Figure 2:
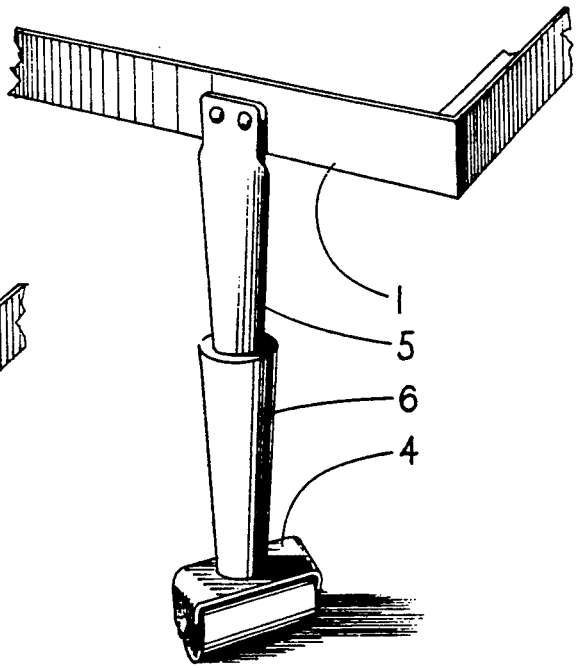
FIG. 2: A perspective view showing in detail an elevator device of the type intended for conical stamped sheet-metal bed leg, as installed.

Refer to FIG. 2; Elevator device, 6, is shown assembled to frame, 1, equipped with a conical stamped sheet-metal leg, 5. Caster/glider is removed and the elevator is pushed onto the end of the leg until firmly seated, 6. Caster/glider, 4, is installed, completing assembly.

Figure 2A:
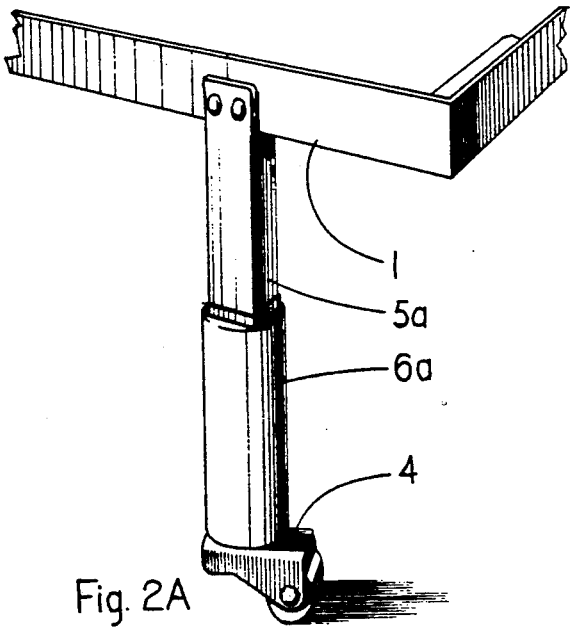
FIG. 2A: A perspective view showing in detail an elevator device of the type intended for bed legs of varied external design and dimension, as installed.

Refer to FIG. 2A; Elevator device, 6*a*, shown assembled to frame, 1, equipped with a leg representative of various designs with no standard external dimension or form, 5*a*. Caster/glider is removed, and elevator device, 6*a*, is installed. Assembly is completed with the installation of caster/glider, 4.

Figure 3:
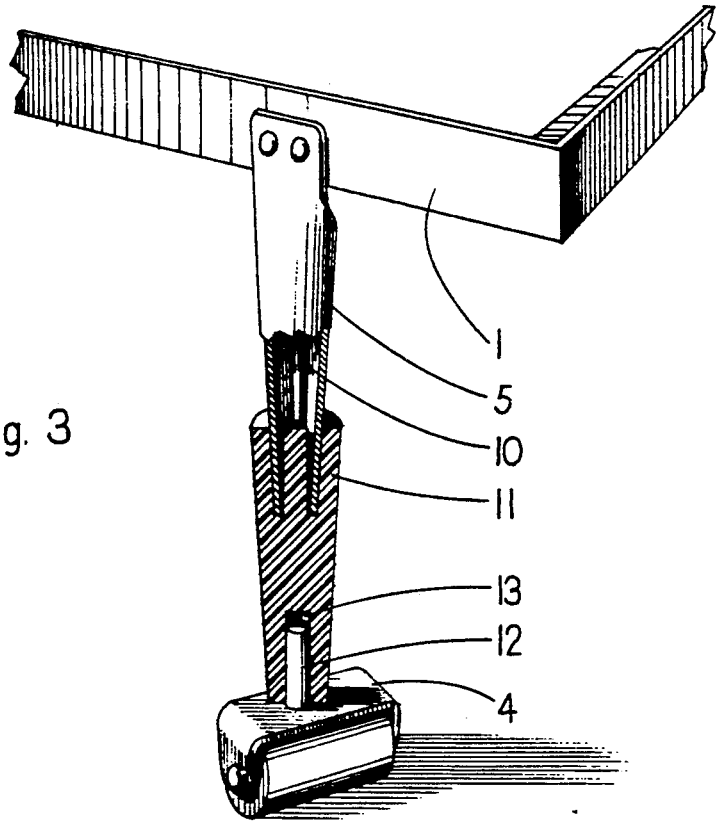
FIG. 3: A perspective partial-sectional view of the type of elevator device shown in FIG. 2, showing details of construction and assembly, as installed.
Figure 3A:
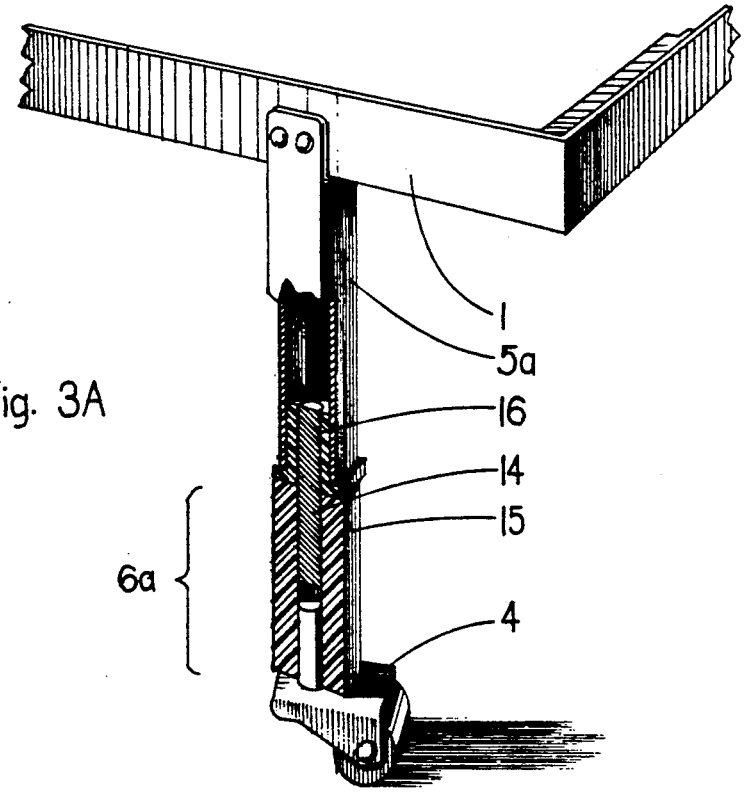
FIG. 3A: A perspective partial-sectional view of the type of elevator device shown in FIG. 2A, showing details of construction and assembly, as installed.

Refer to FIG. 3; Bed-frame, 1, with conical stamped sheet-metal leg, 5, is shown with elevator device, 6, installed with caster/glider, 4. Legs of this type are quite often rolled to shape without being welded, leaving a gap, 10. The design depends on the flexural resistance of the metal to keep the gap, 10, from widening. The integral tapered sleeve on the elevator, 11, encloses the stamping and prevents the gap, 10, from being levered open due to stresses that can arise during lateral movement of the bed. The pivot-pin of the caster/glider, 12, is inserted into receptacle, 13, completing assembly. This version of device consists of a one-piece unit moulded in a tough plastic. Refer to FIG. 3A; Bed-frame, 1, with leg representative of designs that vary in external structure and dimension, 5*a*, is shown assembled with elevator device, 6*a*, and caster/glider, 4. This version of the elevator device relies on a rigid pin, 14, which is inserted into the hole vacated by the caster/glider in the leg, 16, since this is oftentimes the only feature common to the various designs. The device itself consists of a rigid metal pin, 14, pressed or moulded into a tough plastic sleeve, 15, or a technically equivalent one-piece design, both of which have a receptacle for assembling the caster/glider, 4.

Though specific embodiments of the present invention have been disclosed in detail, it is understood that modifications in structure may be adopted without diverging from the spirit of the invention, or the scope of the following claims:

I claim:

1. In a bed having legs supporting the head area of the bed, legs supporting generally the midsection area of the bed, the lower portions of said legs having removably attached thereto glider or caster means, the improvement comprising longer extension devices provided between the legs and glider or caster means at the head area of the bed, and shorter extension devices provided between the legs and glider or caster means at the midsection area of the bed, said extension devices comprising an upper surface area that includes a projection adapted to removably attach the extension device to its respective leg, and a lower surface that includes a cavity that is adapted to removably attach the extension device to its respective glider or caster means whereby the extension devices positioned between the glider or caster means and the legs at the head and midsection area of the bed elevate the head area of the bed relative to the foot area of the bed.

* * * * *